US006595478B2

(12) United States Patent
Lee

(10) Patent No.: US 6,595,478 B2
(45) Date of Patent: Jul. 22, 2003

(54) CURTAIN ROD SUPPORT SYSTEM

(76) Inventor: Han-Sen Lee, 98-1, Show-Tsuo St. Show-Tsuo Village, Fu-Hsing Hsiang, Chang-Hwa Hsien (TW)

( * ) Notice: Subject to any disclaimer, the term of this patent is extended or adjusted under 35 U.S.C. 154(b) by 0 days.

(21) Appl. No.: 09/903,314

(22) Filed: Jul. 10, 2001

(65) Prior Publication Data

US 2003/0010880 A1 Jan. 16, 2003

(51) Int. Cl.[7] ..... A47H 1/10
(52) U.S. Cl. ..... 248/262; 248/251
(58) Field of Search ..... 248/261, 262, 248/267, 316.8, 252, 264, 251, 254; D8/363, 380; 211/88.04

(56) References Cited

U.S. PATENT DOCUMENTS

| | | | | | |
|---|---|---|---|---|---|
| 2,374,787 | A | * | 5/1945 | Spiegel | 211/105.1 |
| 5,071,099 | A | * | 12/1991 | Kuo | 248/224.7 |
| 5,799,804 | A | * | 9/1998 | Sharpe | 211/105.1 |
| 5,875,903 | A | * | 3/1999 | Chen | 211/105.1 |
| 6,113,045 | A | * | 9/2000 | Kuo | 211/105 |
| 6,371,423 | B1 | * | 4/2002 | Miller | 248/221.12 |

FOREIGN PATENT DOCUMENTS

| | | | |
|---|---|---|---|
| DE | 00229581 | * | 11/1909 |
| DE | 3428289 | * | 2/1986 |
| GB | 01545781 | * | 5/1979 |

* cited by examiner

*Primary Examiner*—Ramon O. Ramirez
(74) *Attorney, Agent, or Firm*—Curtis L. Harrington

(57) ABSTRACT

A curtain rod support system includes a support member and a mounting plate attachable to a supporting structure with a pair of screws. The mounting plate has a fixed member, and preferably a threaded member extending therefrom and engageable with the support member, virtually eliminating the need for additional, trial and error adjustment of the mounting plate with respect to the supporting structure. The mounting plate is first affixed to the support structure using the pair of screws, the fixed screw of the mounting plate is inserted into a blind bore in the support member, and the support member is rotated until the screw has essentially fully advanced within the bore. The support member has a second bore completely therethrough and through which a curtain rod may be extended so that the support member bears the weight of the curtain rod and suspended draperies. A finial may be attached to the end of the curtain rod for decorative purposes and to further secure the curtain rod within the bore of the support member.

10 Claims, 1 Drawing Sheet

CURTAIN ROD SUPPORT SYSTEM

FIELD OF THE INVENTION

The present invention relates to the field of window treatments, and more particularly to curtain rod support systems, and provides a mountable structure for securely and positively engaging and supporting a curtain rod.

BACKGROUND OF THE INVENTION

Although conventional curtain rod support systems appear to be simple and straightforward to use, they can present a number of problems upon installation. Typically, conventional curtain rod support systems include a support member and a companion plate fittable to the support member, many of which have a keyhole opening therethrough that narrows at one end, typically the upper end, for engaging an anchoring apparatus such as a screw or nail such that the support member is suspended from the anchoring apparatus. The companion plate is first attached directly to the support member, usually either as packaged or as a pre-installation step. The anchoring apparatus is then inserted into a supporting structure, such as a wall, at the desired location of the curtain rod support system, and the support member with companion plate attached is mounted onto the anchoring apparatus by inserting the anchoring apparatus into the keyhole opening of the plate and engaging the anchoring apparatus within the narrow portion of the keyhole opening so that the support member is suspended from the anchoring apparatus. Should the anchoring apparatus be mounted too far into the supporting structure, it would be impossible to insert the anchoring apparatus into the keyhole opening of the companion plate, given its depth into the support member. In this case, the anchoring apparatus would have to be withdrawn from the supporting structure to a position where the keyhole opening would be fittable over it and suspendable from it. Furthermore, should the anchoring apparatus be mounted too far out of the supporting structure, the anchoring apparatus would need to be advanced farther into the supporting structure so that the support member would not sag when suspended from the anchoring apparatus. Repeated adjustments of the anchoring apparatus into or out of the supporting structure could cause damage to the surrounding sheetrock, plaster, or other composition of which the supporting structure may be constructed. Additionally, unsuccessful attempts to fit the keyhole opening over the anchoring apparatus could cause marring or chipping of the surrounding paint or other finish of the supporting structure. Moreover, if the anchoring apparatus is not firmly set within the narrow portion of the keyhole opening upon engagement, the support structure may sag or may disengage from the anchoring apparatus altogether. This could cause damage to the finish of the supporting structure and, further, could result in injury to anyone who might be standing near or under the support structure.

Yet another problem with conventional curtain rod support systems such as the previously described system is that the weight of the supported curtain rod and any draperies suspended therefrom results in a pivotal force that is concentrated solely on the singular anchoring apparatus. Over time, this force is likely to extract the anchoring apparatus from the supporting structure to which it is attached and particularly from application of a shortened moment of from a shortened distance from the narrow portion of the key hole to the lower wall touching portion of the support member.

The resulting frustration from a trial-and-error depth placement of the anchoring apparatus, and the possible mis-mounting of the keyhole plate at the rear of the curtain rod support will almost guarantee a sloppy installation, even when the installer is expert.

What is therefore needed is a curtain rod support system which facilitates a simple and easy installation and which minimizes the potential for error and thus the need for repeated adjustments. The needed system should provide adequate curtain rod and drapery support, and should distribute the support force resulting from the weight of the supported rod and any draperies so that the possibility of disengagement of the curtain rod support system from the supporting structure to which it is attached is reasonably mitigated.

SUMMARY OF THE INVENTION

The curtain rod support system of the present invention includes a support member and a mounting plate combination attachable to a supporting structure, such as a wall, using a pair of preferably maximum reasonably spaced apart screws or similar hardware. The mounting plate has a fixed threaded member screw, preferably secured to the mounting plate. The formation of the screw to the plate can be accomplished by welding or by insertion through an aperture in the plate, with preferable finishing to flatness of the rear of the plate which will depend from the wall. This may be accomplished by forming an aperture in the plate and insertion of the threaded screw and affixation by a weld or other similarly strong bond, with the back side of the plate finished as by grinding, for example. The screw will preferably extend perpendicularly away from the mounting plate, and the screw or threaded member is to engage a support member once the mounting plate has been secured to a supporting structure. Likewise, the support member has a first end with a bore therein that will accept the fixed screw of the mounting plate. The bore may be a threaded bore where the screw is a machine screw, or the bore may be an un-threaded or threaded bore where the screw is a wood or relatively soft material engagement screw, especially where the screw forms its own threads as the support member is twisted onto the screw. Because the mounting plate screw is initially fixed, before addition of the supporting structure, the need for any adjustment of the mounting plate with respect to the supporting structure is virtually eliminated. The mounting plate is first affixed to the support structure using the pair of screws so that the plate is coplanar with and contiguous to the adjacent supporting structure. The mounting plate screw is then inserted into the blind bore of the first end of the support member, and the support member is subsequently rotated onto the mounting plate screw until the screw is essentially fully advanced within the bore. The support member has a second end that extends generally away from the first end, and which has a bore completely therethrough and perpendicular to the blind bore of the first end. A curtain rod may be extended through the bore of the second end of the support member so that the support member bears the weight of the curtain rod, finials, and any draperies that may be suspended from the curtain rod. Once the curtain rod is extended through the bore in the second end of the support member, a finial may be attached to the end of the curtain rod for decorative purposes and to further secure the curtain rod within the bore of the second end of the support member. Because the mounting plate is attached to the supporting structure using a pair of screws rather than a single screw, the pivotal force exerted on by the weight of the curtain rod, attached finials, and any suspended draperies is distributed between the two screws, thus diminishing the possibility that the mounting plate and support member will be pulled away from the supporting structure.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
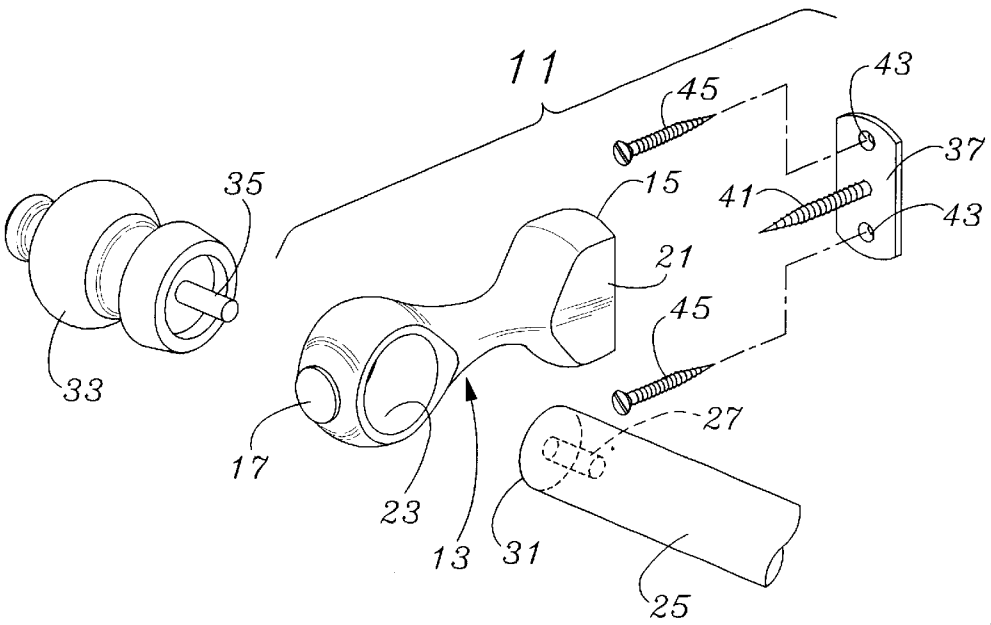
FIG. 1 is an elevated perspective of the curtain rod support system of the present invention in an exploded configuration and adjacent a curtain rod and finial, and illustrates a support member having a first end with a blind bore therein and adjacent a mounting plate and pair of screws, and a second end with a bore therethrough.

The description and operation of the invention will be best initiated with reference to FIG. 1 which illustrates from an elevated perspective the curtain rod support system 11 of the present invention in an exploded configuration. FIG. 1 illustrates a support member 13 having a first end 15 and a second end 17 extending generally away from first end 15. Note that the support member 13 may be constructed from a variety of materials such as wood, metal, resin, or a composite. Additionally, the support member 13 may be any of a variety of overall designs and shapes. First end 15 has a blind bore 21 therein which is illustrated in phantom and which is generally co-axial with an axis of the support member 13. Second end 17 has a large bore 23 therethrough having an axis generally perpendicular to the axis of the support member 13. Large bore 23 is for accepting and supporting a curtain rod 25. Note that while the bore 23 is illustrated as extending completely through the second end 17 of the support member 13, another possible embodiment could include a bore 23 extending only partially through the second end 17 of the support member 13. The curtain rod 25 has a blind bore 27 in its end portion 31 which is illustrated in phantom. The curtain rod support system 11 is shown adjacent an optional finial 33, having a projection 35 frictionally engageable with the blind bore 27 of the end portion 31 of the curtain rod 25 for decorative purposes and perhaps for securing the curtain rod 25 within the large bore 23 of the second end 17 of the support member 13, where such special arrangement is made. Note that if the bore 23 extended only partially through the second end 17 of support member 13, the need for finial 33 would be eliminated. A mounting plate 37 is shown adjacent the first end 15 of support member 13. Although the overall shape of the mounting plate 37 is illustrated as generally rectangular with curved ends to coincide with the overall shape of the first end 15 of the support member 13 illustrated in FIG. 1, note that the mounting plate can occupy any shape that will aesthetically coincides with the shape of the first end 15 of the support member 13. In one aspect, it is important that the end 15 of any support member 13 either cover or match the extent of the mounting plate 37. Mounting plate 37 has a fixed threaded member or screw 41 that extends perpendicularly away from the plane of the mounting plate 37. The fixed screw 41 is preferably secured to the mounting plate 37 with a weld or a similarly strong bond. Where the weld is at the front of the mounting plate 37, a chamfer may be had at the first end 15 of the support member 13 to accommodate the weld. Additionally, the fixed screw 41 may be a wood screw, a metal screw, or any other screw appropriate for use with the material of which the support member 13 is constructed, or of the fittings had and supported by the support member 13. Mounting plate 37 has a pair of apertures 43 and which are situated adjacent either side of fixed screw 41. Also illustrated in FIG. 1 is a pair of screws 45 adjacent mounting plate 37. Once the mounting plate 37 has been secured to a supporting structure (not illustrated) using the pair of screws 45, the support member 13 is joined with the fixed screw 41 of the mounting plate 37 by inserting the fixed screw 41 into the blind bore 21 of the first end 15 of the support member 13 and rotating the support member 13 until the fixed screw 41 has advanced essentially the full length of the blind bore 21, to the extent possible. The support member 13 may then be rotated such that the axis of the large bore 23 of the second end 17 of the support member 13 makes an angle of either zero or one-hundred eighty degrees with respect to the axis of the curtain rod 25, especially since the support member 13 has bi-lateral symmetry. This simplest of periodic symmetry is shown to illustrate the other symmetries available. For example, were the mounting plate 37 to be round, the symmetry would be limited by the large bore 23. If the large bore 23 was a fitting having a pair of crossing bores, the symmetry would be subdivided into ninety degree increments. Any additional symmetry enabling the support member 13 to achieve alignment with a lesser number of turns is encouraged. Other helps can be had as by having the end 15 to be fitted with a deformable material, or even a seal to distribute the support of the end 15 of the support member 13 firmly across the plate 37.

Using the pair of screws 45 allows the pivotal force resulting from the weight of the curtain rod 25 and any attached finial 33 and drapery to be distributed between the pair screws 45 to give increased stability. This particular distribution of force is preferable to that which occurs using only a single anchoring structure since it aids in preventing disengagement of the curtain rod support system from a supporting structure. Once the curtain rod 25 is extended through the large bore 23 of the second end 17 of the support member 13 and any draperies (not illustrated) have been suspended from the curtain rod 25, the projection 35 of the finial 33 may be frictionally engaged with the blind bore 27 of the end portion 31 of the curtain rod 25 as a finishing measure and to ensure that the curtain rod 25 stays seated within the large bore 23 of the second end 17 of the support member 13.

Figure 2:
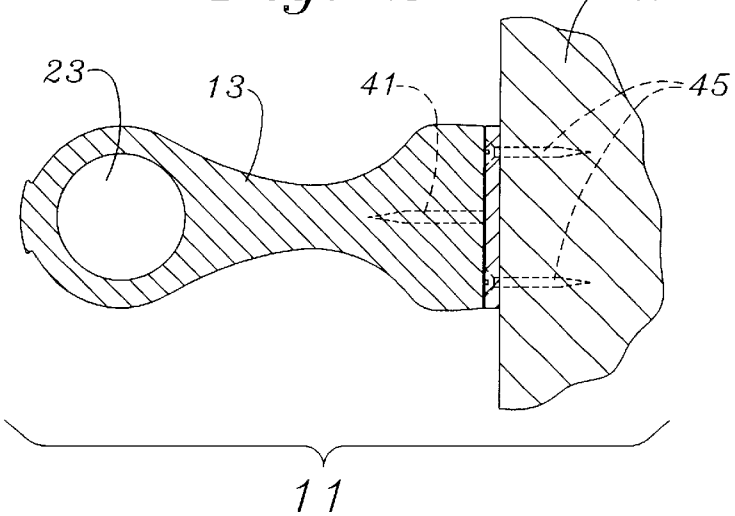
FIG. 2 is a cross-sectional view of the curtain rod support system which illustrates the mounting plate attached to a supporting structure using the pair of screws and the support member attached to the fixed screw of the mounting plate.

FIG. 2 is a cross-sectional view of the curtain rod support system 11 as mounted to a supporting structure 47. FIG. 2 illustrates mounting plate 37 attached to supporting structure 47 with the pair of screws 45. Support member 13 is shown attached to the fixed screw 41 of mounting plate 37. The bore 23 in the second end 17 of the support member 13 is illustrated clearly in FIG. 2.

While the present invention has been described in terms of a curtain rod support system, the principles contained therein are applicable to other types of rod support systems.

Although the invention is derived with reference to particular illustrative embodiments, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A curtain rod support system comprising:

a mounting plate having at least one aperture therethrough and having a projection thereon at about the center of said mounting plate and integrally attached to said mounting plate and extending away from a first surface of said mounting plate, said projection perpendicular to and extending generally away from said first surface of said mounting plate, said mounting plate attachable to a supporting structure at said at least one aperture;

a support member having a first end and a second end, said first end having a blind bore therein, said bore collinear with a longitudinal axis of said support member, said projection of said mounting plate engageable with said bore of said first end of said support member for attaching said support member to said mounting plate by moving said support member blind bore onto said projection after said mounting plate is secured to said supporting structure to overlie and substantially cover said first surface of said mounting plate and said second end having a bore therein for supporting a curtain rod.

2. The curtain rod support system as recited in claim 1 and wherein said mounting plate has at least two apertures therethrough, and situated at opposite sides of said projection.

3. The curtain rod support system as recited in claim 2 and further comprising a pair of screws, extendable through each of said at least two apertures and into a supporting structure for attaching said mounting plate to said supporting structure and wherein said pair of screws and said at least two apertures are arranged to enable insertion of said screws behind said first surface of said mounting plate.

4. The curtain rod support system as recited in claim 1 wherein said bore of said second end of said support member extends partially through said second end of said support member.

5. The curtain rod support system as recited in claim 1 wherein said bore of said second end of said support member extends completely through said second end of said support member.

6. The curtain rod support system as recited in claim 1 and wherein said projection of said mounting plate is a screw, said screw engageable with blind said bore of said support member for attaching said support member to said mounting plate.

7. The curtain rod support system as recited in claim 1 and wherein said blind bore of said first end of said support member is frictionally engageable with said projection of said mounting plate for attaching said support member to said mounting plate.

8. The curtain rod support system as recited in claim 1 and further comprising a curtain rod, said curtain rod having a bore in each end, said bore in each of said ends collinear with the longitudinal axis of said curtain rod.

9. The curtain rod support system as recited in claim 8 and further comprising at least one finial, said at least one finial having a projection thereon, said projection frictionally engageable with said bore of said curtain rod for securing said curtain rod with respect to its support from said support member.

10. A curtain rod support system comprising:

a mounting plate having at least two apertures therethrough and having an integrally attached projection thereon, said projection perpendicular to the plane of said mounting plate and extending beyond a first surface of said mounting plate, and situated at about the center of said mounting plate, and extending generally away from said mounting plate, said mounting plate attachable to a supporting structure at said at least two apertures;

a support member having a first end and a second end, said first end having a blind bore therein, said blind bore collinear with the longitudinal axis of said support member, said projection of said mounting plate engageable with said bore of said first end of said support member for attaching said support member to said mounting plate by moving said support member blind bore onto said projection after said mounting plate is secured to said supporting structure to overlie and substantially cover said first surface of said mounting plate, and said second end having a bore therethrough for supporting a curtain rod;

a pair of screws extendable through said at least two apertures of said mounting plate and into a supporting structure for attaching said mounting plate to said supporting structure;

a curtain rod, said curtain rod having a bore in each end, said bore in each of said ends collinear with the longitudinal axis of said curtain rod;

at least one finial, said at least one finial having a projection thereon, said projection engageable with said bore of said curtain rod for securing said curtain rod within said bore of said support member.

* * * * *